United States Patent [19]

McDade

[11] Patent Number: 4,751,798

[45] Date of Patent: Jun. 21, 1988

[54] SHOT BLASTING APPARATUS

[76] Inventor: Bernard F. McDade, 209 Aiken Rd., Chattanooga, Tenn. 37421

[21] Appl. No.: 75,237

[22] Filed: Jul. 17, 1987

Related U.S. Application Data

[63] Continuation of Ser. No. 870,517, Jun. 4, 1986, abandoned.

[51] Int. Cl.[4] ..... B24C 5/06

[52] U.S. Cl. ..... 51/432; 51/434; 51/435; 51/268; 416/220 A

[58] Field of Search ..... 51/268, 410, 431, 432, 51/433, 434, 435; 241/275; 416/214 R, 219 R, 219 A, 220 R, 220 A

[56] References Cited

U.S. PATENT DOCUMENTS

| | | | |
|---|---|---|---|
| 2,352,588 | 6/1944 | Rosenberger et al. | 51/432 |
| 2,442,678 | 6/1948 | Dybiec | 51/268 X |
| 3,744,190 | 7/1973 | DeGroot et al. | 51/431 X |
| 4,069,025 | 1/1978 | Macmillan | 51/435 X |
| 4,207,712 | 6/1980 | Toedtli | 51/435 X |
| 4,333,278 | 6/1982 | Schulte et al. | 51/435 X |
| 4,395,851 | 8/1983 | Watts | 51/434 |

*Primary Examiner*—Robert P. Olszewski
*Attorney, Agent, or Firm*—James B. Middleton

[57] ABSTRACT

A shot blasting machine is arranged for simplicity in servicing and for efficiency in operation. The number of vanes in the blast wheel is equal to the number of blades in the impeller, and the connector to connect the blast wheel to the drive hub is arranged so that the timing of the wheel is the same regardless of the orientation of the connector with respect to the drive hub and the impeller. The control cage is of a large diameter, with commensurately large impeller, so the vanes can be installed through the central opening of the wheel. Further, the vanes slide into grooves in the blast wheel, frictionally held by leaf springs, and restrained by stops in one direction only.

6 Claims, 3 Drawing Sheets

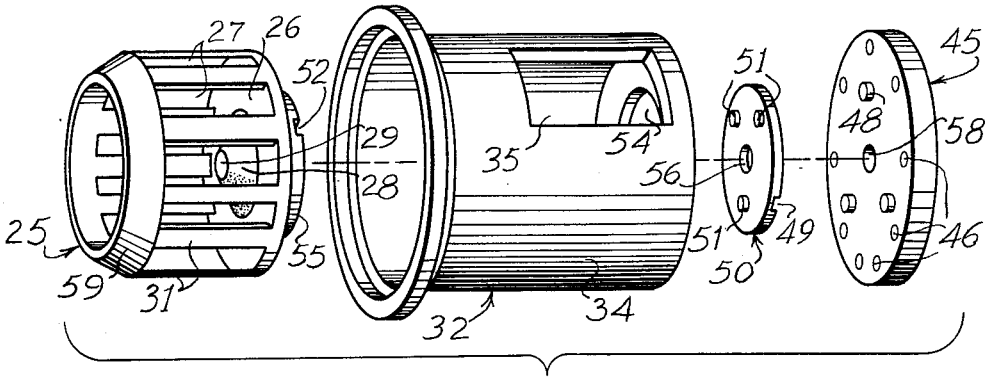
Fig_4
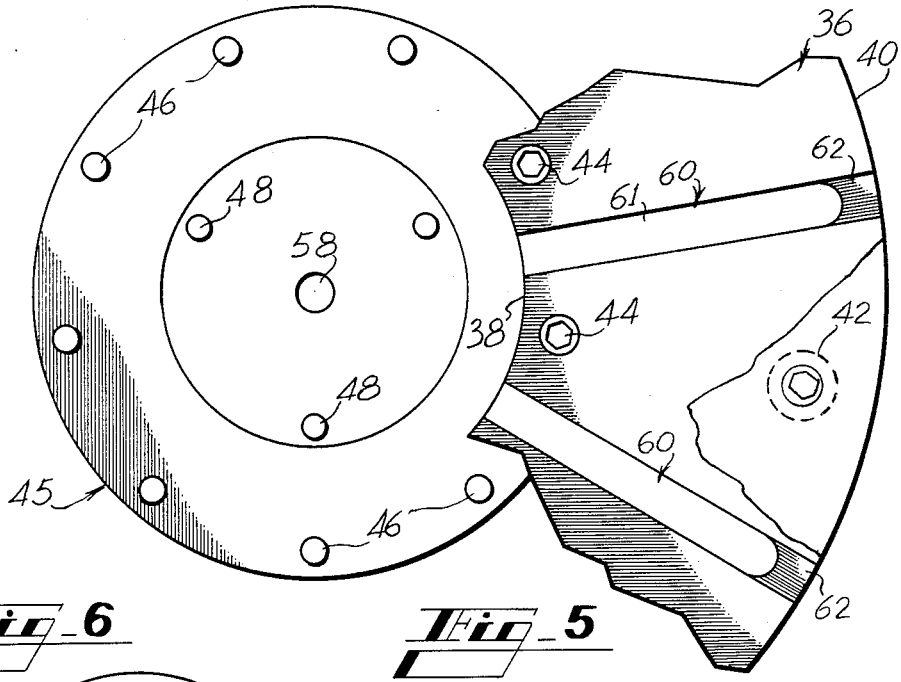
Fig_6
Fig_5
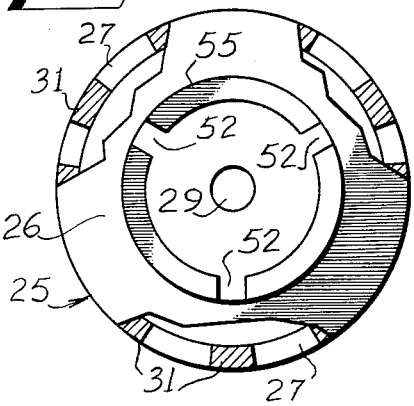
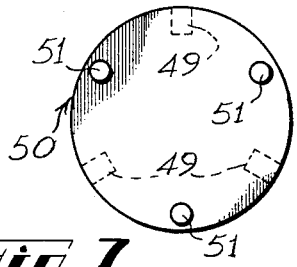
Fig_7

SHOT BLASTING APPARATUS

This application is a continuation of application Ser. No. 870,517, filed June 4, 1986, now abandoned.

INFORMATION DISCLOSURE STATEMENT

Shot blasting is well known in the art, and the patent literature includes a number of designs for centrifugal impelling means. The closest prior patent known to the inventor is U.S. Pat. No. 4,395,851 issued Aug. 2, 1983. The present invention was instrumental in the creation of the apparatus disclosed in that patent, and is aware of some of the shortcomings of that apparatus.

Since shot blasting is achieved by accelerating shot, or small metal spheres, to a relatively high velocity, and directing the shot towards material to be treated, it is important to achieve reasonable efficiency in putting energy into the shot, and also in controlling the area of impact of the shot. The typical operation includes the feeding of shot into the center of a rotating impeller, then feeding the shot through a discrete opening in a control cage, the shot then being further accelerated by blades, or vanes of a blast wheel. It will therefore be understood that reasonably direct flow of the shot through this path will be energy efficient, while deviations from this path amount to inefficiencies in the apparatus. In the prior art apparatus, it is common for shot to be passed through the opening in the control cage at a fairly low velocity, and to strike the vanes at a point well outward of the axis of rotation. This action causes the vanes to hit the shot, and the shot tends to take away the metal of the vanes. This is both destructive of the vanes, and absorbs energy that would preferably be directed towards the material being treated. It is also common in prior art apparatus for shot to be discharged from the vanes against various portions of the housing for the apparatus. Since the shot are moving at relatively high velocities, the shot will bounce from the housing, back to the blast wheel, and be thrown in another direction. As long as the shot is bouncing from portions of the blast wheel and the housing for the wheel, it will be understood that the energy is completely wasted, and further that this is destructive of the apparatus.

Prior art shot blasting apparatus has been constructed in the realization that the lining for the wheel housing must be replaced because the nature of the blasting apparatus destroys the apparatus itself. In an effort to render replacement as simple as possible, and further to allow replacement of only those portions that are damaged, wheel housing liners have been made in numerous parts. It is the nature of shot, however, that the area of greatest destruction is an area of a crack or other aberration. As a result, the use of a large number of pieces for the lining for the wheel housing tends to hasten the destruction of the lining.

Thus, the prior art is lacking in blasting wheel apparatus constructed for proper timing of the shot for maximum efficiency of the apparatus and minimum destruction of the apparatus itself.

SUMMARY OF THE INVENTION

This invention relates generally to shot blasting apparatus, and is more particularly concerned with an improved shot blasting apparatus having accurate timing means for minimum destruction of the apparatus with maximum efficiency and control of the shot.

The present invention provides a blast wheel having an exceptionally large impeller, and a control cage that easily receives the impeller. Timing means are provided such that the impeller and the blast wheel are always properly set with respect to each other, and the control cage can be varied to change the location of the concentration of the blasting pattern. The timing means is so constructed that the apparatus cannot be improperly assembled to yield improper timing, thereby assuring that the timing and efficiency of the wheel are always properly set. Further, the timing arrangement renders assembly and disassembly of the apparatus very simple for servicing by one person.

The blast wheel blades, or vanes, are easily inserted from the center of the blast wheel, the vanes being held temporarily by friction means, but mechanically held by centrifugal locking means during operation. Further, the vanes are symmetrically constructed so the vanes cannot be inserted improperly. Another advantage to this construction is that the vanes can be reoriented within the blast wheel so that four different faces are presented to the shot for exceptionally long life of the vane. The symmetry also allows the blast wheel to be driven in either direction with equal efficiency in operation.

The housing for the wheel is provided with a lining that is replaceable, and the lining comprises a minimum number of pieces. The pieces of the lining are all interlocked for minimum destruction by the shot, and the pieces are arranged for easy removal and replacement.

BRIEF DESCRIPTION OF THE DRAWINGS

These and other features and advantages of the present invention will become apparent from consideration of the following specification when taken in conjunction with the accompanying drawings in which:

FIG. 4 is an exploded perspective view showing the drive connector, impeller and control cage, with the wheel omitted for clarity;

FIG. 5 is a front elevational view of the wheel mounting hub with the wheel shown fragmentarily;

FIG. 6 is a rear elevational view of the impeller, partially broken away;

FIG. 7 is a front elevational view of the connector plate for the impeller;

DETAILED DESCRIPTION OF THE EMBODIMENT

Figure 1:
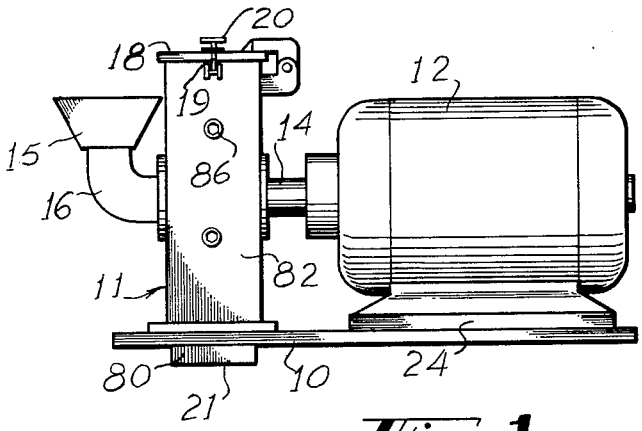
FIG. 1 is a side elevational view of a shot blasting apparatus made in accordance with the present invention.

Referring now more particularly to the drawings, and to that embodiment of the invention here presented by way of illustration, FIG. 1 of the drawings shows a base plate 10 having the blast wheel housing generally designated at 11. The blast wheel is driven by a motor 12 that is mounted on the base plate 10, the motor 12 having a shaft 14 to which the blast wheel is connected.

On the opposite side of the housing 11, there is a hopper 15 for receiving shot, and an elbow 16 directs the shot into the housing 11. It is important that the elbow 16 maintains the full diameter to prevent restriction of flow of the shot into the housing 11.

The housing 11 is provided with an easily openable cover 18 having hold down screws 19. With attention to both FIGS. 1 and 2, it will be seen that the hold down screws 19 include a pivoted screw receivable in an appropriate notch in the cover 18, and a T-nut 20 threadedly engaging the screw to hold the cover 18.

Figure 2:
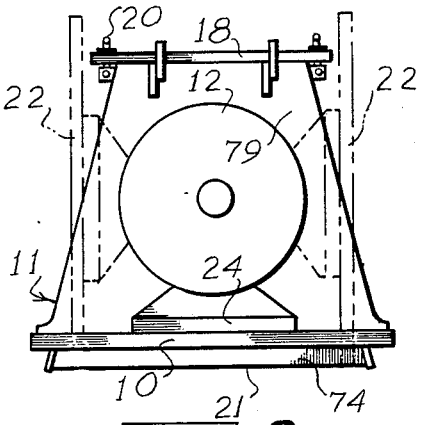
FIG. 2 is a rear elevational view of the apparatus shown in FIG. 1, and having broken line representations showing alternate motor mountings.

Looking further at FIG. 2 of the drawings, it will be understood by those skilled in the art that the housing 11 may be directed as desired for discharging the shot. The wheel housing liner extends below the base plate 10 as is indicated generally at 21, 21 designating the area of discharge for the shot. Thus, as pictured in FIGS. 1 and 2, the shot will be discharged downwardly. If the shot is to be discharged to one side or the other, the base plate 10 will be rotated and appropriately mounted. In this event, it will be understood that the motor 12 should be mounted in an upright condition. Therefore, motor mounting shelves 22 may be utilized as shown in broken lines.

While many prior art blasting wheels require major alternation for the use of different power inputs, the wheel of the present invention can be operated with a wide range of power input without alteration except for the motor itself. The motor 12 is here shown as being mounted on a block 24. For a smaller, lower power motor, one would simply use a larger block 24 in order to place the shaft 14 at the center of the housing 11. Conversely, for a larger motor 12, one would use a smaller block 24, or no block 24, so the shaft 14 of the motor 12 will be disposed at the axis of the housing 11. Thus, it is contemplated that the apparatus of the present invention will accommodate a motor 12 from a motor as small as a 30 hp up to at least a 75 hp motor with no change other than the size of the block 24.

Figure 3:
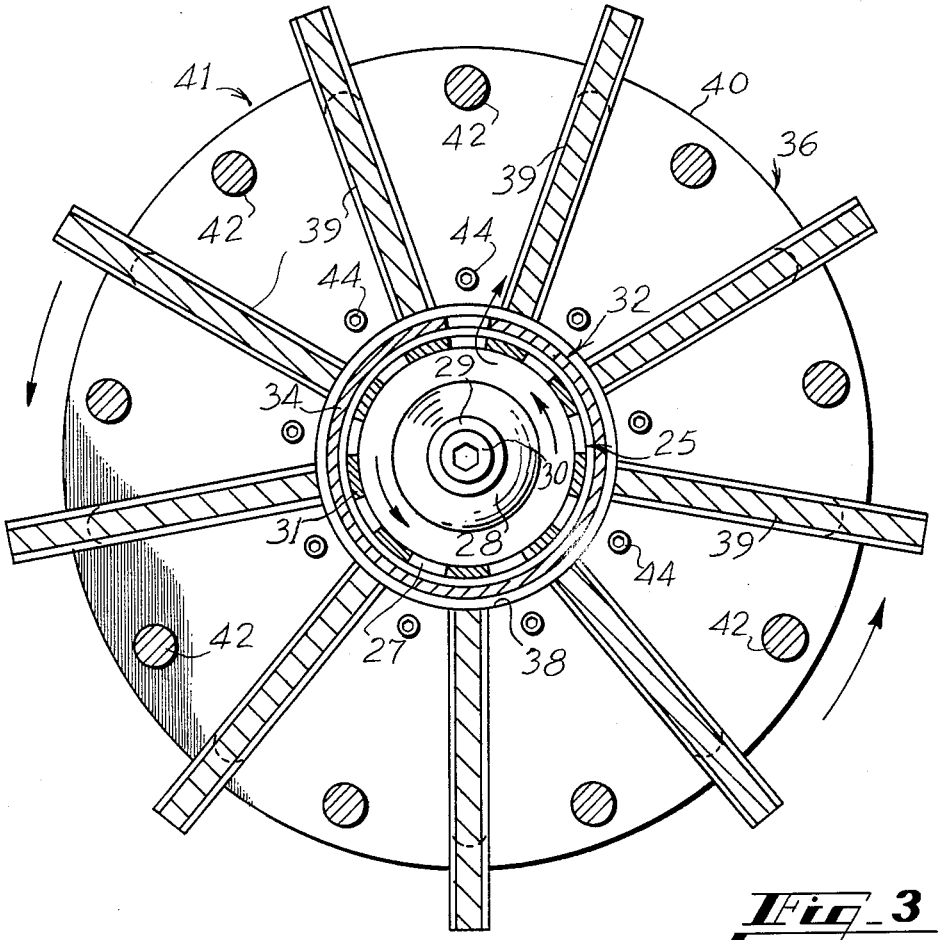
FIG. 3 is a cross-sectional view through the blast wheel of the present invention, the housing being omitted for clarity.

Attention is next directed to FIG. 3 of the drawings. It should first be understood that FIG. 3 is a cross-sectional view taken between and parallel to the front and rear plates of the wheel. Therefore, the impeller, the control cage, and the vanes themselves, are in cross-section, and the rear wheel plate is illustrated.

With this in mind, it will be seen that the impeller is generally designated at 25 and includes a rear, or base, plate 26 having a boss 28 centrally thereof. In the center of the boss 28, there is a hole 29 for receiving a screw 30. This construction will be discussed in more detail hereinafter.

The circumference of the impeller 25 is made up of a plurality of impeller blades 31 uniformly distributed around the base plate 26 and at the periphery thereof, thereby defining impeller openings 27.

The control cage is generally designated at 32, and includes a side wall 34 with a single discharge opening 35.

Outwardly of the wall 34 of the control cage 32, the inner edge of the rear wheel plate 36 is shown. Generally at this inner edge 38, the plurality of vanes 39 begin, and the vanes extend outwardly beyond the outer periphery 40 of the wheel plate 36.

At this point it will be seen that each of the impeller blades 31 is precisely aligned with one of the vanes 39 so that each impeller opening 27 is centered between two of the vanes 39. This is part of the important timing of the blast wheel, and the construction to assure this arrangement will be discussed below. As viewed in FIG. 3, shot will be fed towards the base plate 26 of the impeller 25, and will move radially outwardly by centrifugal force. The plurality of impeller blades 31 will positively move the shot; and, it will be understood that the large quantity of shot being fed to the blast wheel acts very much as a fluid so that much of the shot will receive rotational energy even though not positively engaged by one of the impeller blades 31. Also because of the fact that the shot will act largely as a fluid, the space between the outside of the impeller 25 and the inside of the control cage 32 need not be small enough to attempt to exclude shot. Blast wheels in fact utilize such small shot that the exclusion of shot is virtually impossible. Thus, there can be adequate space between the impeller 25 and the control cage 32 to allow an easy fit, and operation will be highly satisfactory.

Since the shot within the control cage 32 will be accelerated to a rather high velocity, and will tend to move outwardly because of centrifugal force, when the shot reaches the discharge opening 35 in the control cage 32, the shot will pass outwardly of the control cage 32. As the shot flows through the discharge opening 35, it will be understood that the wheel generally designated at 41 will be rotating. Thus, the vanes 39 will engage the shot as the shot leaves the discharge opening 35.

It must be realized that the impeller 25 is rotating, and the control cage 32 is stationary, while the wheel 41 is rotating. Thus, the shot is fed from the impeller 25, through the discharge opening 35 and on to the vanes 39. For maximum efficiency, it will be understood that the shot should engage the vane 39 as close as possible to the inner edge 38 of the wheel plate 36. Further, the shot is thrown through the stationary opening 35 so proper handling of the shot is a matter of timing.

To achieve the ideal timing in the present apparatus, one will provide the desired diameter of impeller 25 and control cage 32, with the preferred vanes 39. The impeller blades 31 of the impeller 25 should be made exceptionally wide. A test should then be run to determine where the shot hits the vanes 39. If the impeller blades 31 are too wide, the shot will hit the vanes 39 outwardly of their inner ends. In this event, the impeller blades 31 will be narrowed somewhat. The process should continue until the shot engage the vanes 39 substantially at their innermost ends. While no means is known to determine the exact dimensions initially, this procedure will produce virtually ideal results with only a few trials.

Once the shot is on the vanes 39, it will be understood that the vanes 39 are rotating so that the shot will continue to move outwardly by centrifugal force. Also, it will be realized that the impeller 25 and the wheel 41 are rotating at exactly the same number of revolutions per minute so that, as the shot moves outwardly to a greater radius, the velocity of the shot in feet per minute will be increasing. When the shot reaches the outer tip of the vanes 39, the shot will have achieved its highest velocity, and should be discharged from the blast wheel.

As an empirical fact, the shot in a blast wheel as illustrated is generally discharged at about 120° from the discharge opening in the control cage. Because of this, one can rotate the control cage 32 to vary the location of the opening 35 and vary the distribution pattern for the shot discharged.

Returning to the constructional details illustrated in FIG. 3 of the drawings, it will be seen that there are nine vanes 39, and of course nine impeller blades 31. Between the vanes 39, there are plates spacers 42. On the same radius with each of the spacers 42, there is a screw 44 for mounting the plate 36 to the hub as will be discussed hereinafter.

Attention is next directed to FIG. 4 of the drawings. FIG. 4 illustrates the hub 45 which will be carried by the shaft 14 of the motor 12. The hub 45 is provided with a plurality of tapped holes 46 for receiving the screws 44. Though the rear wheel plate 36 will normally be mounted against the hub 45, the plate is omitted from FIG. 4 in order to show other parts more clearly.

The hub 45 also includes three projections 48. These projections 48 may be conveniently provided by screws with hexagonal heads, though of course those skilled in the art will readily recognize that projections may be cast with the hub 45, pins may be pressed thereinto, and other similar structure may be equally well utilized. In any event, the projections 48 are adapted to be received within notches 49 on the rear face of a connector plate 50. The connector plate 50, then, includes three projections 51 extending forwardly thereof. The projections 51 are adapted to be received within grooves 52 on the rear of the impeller 25.

FIG. 4 shows the construction of the impeller 25 and control cage 32 in more detail, so FIG. 4 should be considered in combination with FIG. 3. It will then be seen that the hub 45 is connected to the shaft of the motor to provide rotation, and the connector 50 is placed against the face of the hub 45 with the projections 48 received in the notches 49. The connector 50 is sized to rotate freely within the rear opening 54 in the control cage 32; and, the rear projection 55 on the base plate 26 of the impeller 25 is placed against the connector 50 with the projections 51 received within the grooves 52. Thus, the motor rotates the hub 45, the hub 45 rotates the connector 50, and the connector 50 rotates the impeller 25. The control cage 32 is stationary, being held against the wheel housing 11. The screw 30 passes through the opening 29 in the impeller, and passes through the central hole 56 in the connector 50, and is threadedly engaged through the opening 58 in the hub 45, into the motor shaft 14.

Still looking at FIG. 4 of the drawings, it is important to notice that the impeller openings 27 between the impeller blades 31 are substantially uniform from the base plate 26 to the upper ring 59. Since shot must pass from the central opening within the impeller 25, through the openings 47 between the impeller blades 31, it should be realized that uniform feeding of the shot is desired, and uniform openings are required for such uniform feeding.

Similarly, it will be seen that the discharge opening 35 in the control cage 32 is rectangular. The opening 35 should have an axial length substantially equal to the axial length of the openings between the impeller blades 31 so that, again, discharge of the shot can be uniform axially of the apparatus.

Looking now at FIG. 5 of the drawings, the hub 45 is shown in front elevation; and, the rear wheel plate 36 is shown fragmentarily, attached to the hub 45 by screws 44, with the front wheel plate also shown fragmentarily. Here, it will be seen that the vanes 39 are received within grooves 60 in the plate 36. The grooves 60 include two different depths of grooves, the inner portion of the groove designated at 61 having about twice the depth of the outermost portion of the groove designated at 62. It will be seen that the transition between the portion 61 and the portion 62 is on a radius, and this will be discussed in more detail hereinafter.

Looking now at FIGS. 6 and 7, these figures show the rear of the base plate 26 of the impeller 25 and the front face of the connector 50. With the foregoing discussion in mind, the importance of the timing cannot be over emphasized. Further, it is very important for the blasting apparatus to be both easy to assemble correctly, and difficult to assemble incorrectly. It must be realized that shot blasting apparatus is sometimes dismantled by the owners who may know very little about blasting wheels, and sometimes by service people who are not sufficiently skilled. Unless one understands the operation of the wheel quite thoroughly, the wheel may be assembled incorrectly if it is possible to do so.

Virtually every prior art blast wheel must have some coupling means for connecting the impeller to the hub, and these connecting means normally include projections and recesses to be mated and the like. The prior art blast wheels, however, normally include either a single spot on the periphery, or two spots on the periphery. While the use of a single spot will obviously require a single rotational orientation, such construction is very unstable and the impeller is generally able to rotate with respect to the impeller wheel to yield improper timing. With two locations diametrically opposed, it is obvious that there are two rotational orientations that are possible. Usually, one such orientation is correct and the other is incorrect so there is a 50% probability that the wheel will be assembled incorrectly by a person not sufficiently knowledgeable to look at other aspects of the wheel.

Returning now to the construction of the present invention, it will be remembered that there are nine vanes 39, and nine of the impeller blades 31. There are then three of the notches 52 in the base 55 in the impeller 25, and these notches 52 are precisely aligned with three of the impeller blades 31. Further, the three notches 52 are equally spaced, located 120° of arc apart.

In conjunction with the notches 52 on the impeller 25, the connector 50 has the three protrusions 51 located to be received within the notches 52. The protrusions 51 are therefore 120° apart. The rear face of the connector 50 defines the notches 49. These notches 49 are shown in broken lines in FIG. 7, and it will be seen that the notches 49 are located halfway between the protrusions 51, and the notches 49 are located 120° apart. As was previously stated, the notches 49 are adapted to receive the protrusions 48 on the hub 45.

With the above discussion in mind, it should be realized that the hub 45 is rotated directly by the shaft of the motor 12, and the hub 45 carries the wheel plates such as the plate 36. Since the plate 36 is fixed to the hub 45, the slots 60 to receive vanes 39 are fixed with respect to the hub 45, and the relationship is preset by accurate placement of the holes for the screws 44 and the holes 46 in the hub 45. The connector 50 is then precisely located with respect to the hub 45 because there are three positions possible for the adapter 50, and all of the positions are precisely 120° apart from one another. The impeller 25 is then receivable on the adapter 50 also in three possible positions, the three possible positions being 120° from one another. Because there are nine vanes 39 and nine impeller blades 31, and the impeller blades 31 are precisely aligned with the notches 52, it will be understood that, regardless of the location chosen for the impeller and the connector 50, the relationship between the impeller blades 31 and the vanes 39 will always be precisely the same. The relationship illustrated in FIG. 3 will therefore always be the same, regardless of the manner of assembly of the blast wheel of the present invention. As a consequence, the flow of the shot described in conjunction with FIG. 3 of the drawings will remain the same.

The use of nine vanes as shown in the drawings provides excellent results, and constitutes the preferred embodiment of the present invention. It should be understood, however, that other numbers are possible, retaining the above discussed advantages of timing. As is implied in the foregoing, the relationship must be maintained, though specific numbers can change.

To assure proper timing of the blast wheel, the connector 50 must have no incorrect positions. Thus, the notches 49 and the projections 48 must be equally spaced so that all rotational positions that fit are correct positions. Next, the projections 51 on the connector 50 must be equally distributed, and must have a commensurate relationship with respect to the notches 49. Finally, the grooves 52 on the impeller must always be aligned with impeller blades, and must of course be located to receive the projections 51.

Once the number of vanes 39 is selected, one can determine the degrees of arc separating the vanes. The degrees separating the vanes multiplied by the number of timing pins (i.e., projections 51 or 48) must be commensurate with the degrees of arc separating the timing pins. For example, 9 blades will be 40° apart, multiplied by 3 timing pins equals 120°. If one select 6 blades, they will be 60° apart, multiplied by 3 timing pins equals 180°. Since the 180° result is incommensurable with the required 120° separation for 3 pins, these numbers are inoperable.

Eight vanes can be used, and it will be understood that four timing pins must be used: $360°/8=45°\times4=180°$. Four pins equally spaced will be 90° apart, and 90° is commensurable with 180°, so this is a possible combination. It will further be seen that the number of pins can equal the number of vanes, and the above formula will always work; however, there is a practical limit to the number of timing pins and the numbers should be chosen for both timing and practicality.

Figure 8:
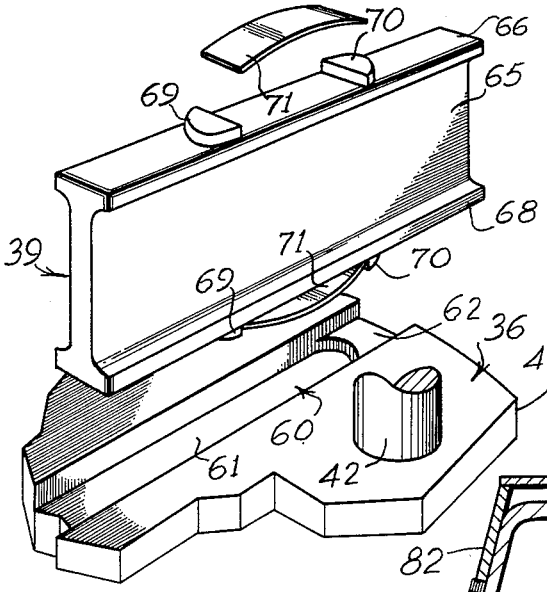
FIG. 8 is an exploded perspective view showing the vane mounting means.

Looking now at FIG. 8 in conjunction with FIG. 3, the vane 39 is shown in detail to illustrate the means for holding the vanes 39 between the plates of the wheel 41.

It will be seen that the vane 39 is formed somewhat as a I-beam including a central web 65 and side rails 66 and 68. The web 65 and the rails 66 and 68 are precisely uniform throughout the length of the vane 39.

Extending from the rails 66 and 68, there are stops 69 and 70, the stops 69 being inwardly of the wheel as shown in FIG. 8 of the drawings, and the stops 70 being outwardly of the wheel. Between the stops 69 and 70, a flat spring 71 may be received. The spring 71 is here shown as a leaf spring, preferably having a length to be just received between the stops 69 and 70. The springs 71 are preferably curved sufficiently that the spring will bear against the bottom of the groove 61.

It should now be understood that the vane 39 will be provided with the two of the springs 71 between the stops 69 and 70 adjacent to each of the rails 66 and 68. The central opening in the wheel 40 is sufficient to receive the vane 39 along a diameter thereof, and the rails 66 and 68 can be slid into the grooves 61 in the front and rear wheel plates 36. The spring 71 can be held inwardly as the vane 39 is slid into the grooves 60. Even with the spring 71 bearing against the groove 60, one person can easily urge the vane 39 radially outwardly of the wheel 41. Since the stops 70 will extend substantially to the bottom of the groove portion 61, the stop 70 will engage the curved inner edge at the transition between the portion 61 and the portion 62. The rails 66 and 68 can extend between the portions 62 of the groove 60 so the vanes can take the positions as shown in FIG. 3 of the drawings. However, rotation of the wheel 41 will cause centrifugal force to urge the vanes 39 outwardly, and this force will be counteracted by the stop 71 acting against the curved inner surface of the portion 62 of the groove 60.

Because of this construction, when the blades are to be changed, or reoriented, one can simply tap the vane 39 to release the shot from the groove, and manually pull the vane 39 from the groove 60. The vane can then be reoriented and reinserted as described.

Also, because of the symmetric construction of the vane 39, it will be seen that the vane as shown in FIG. 3 can be rotated about its longitudinal axis without effective change, or can be rotated about its lateral axis without an effective change. Thus, all faces of the vane 39 can be utilized as the working face, and the vane 39 can be completely worn before the vane must be replaced.

Figure 9:
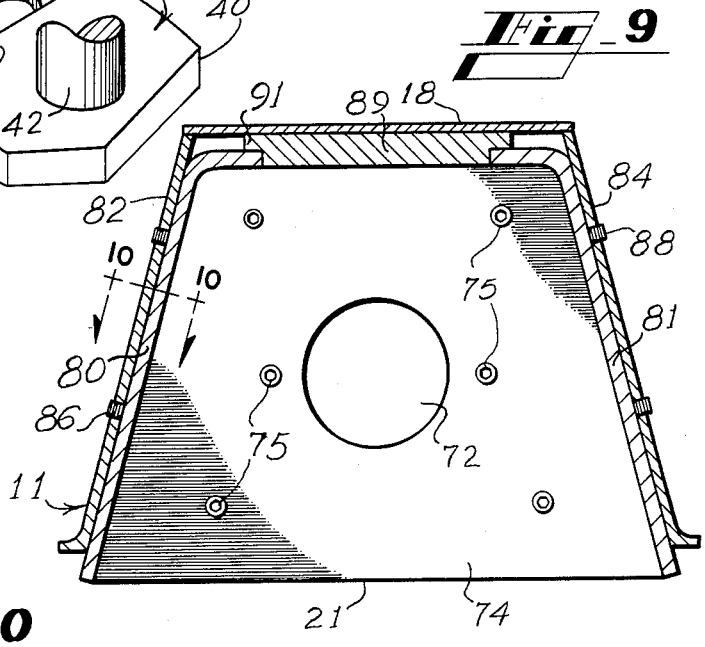
FIG. 9 is a cross-sectional view through the blast wheel housing, with the wheel omitted for clarity.

FIG. 9 of the drawings shows the housing 11 with the cover 18, and there is a hole 72 for receiving the hub 45. In FIG. 9, all parts of the wheel and hub have been omitted to illustrate the housing 11 and the housing liners more clearly.

There is shown in FIG. 9 a rear liner 74, and this liner 74 is attached to the rear wall of the housing 11 by a plurality of screws designated at 75. There is a front liner 76 shown fragmentarily in FIG. 10, which will be substantially like the rear liner 74, and will be fixed to the front wall 78 of the housing 11 by screws comparable to the screws 75. It is important to notice in FIG. 9 that the rear wall liner 74 comprises a single piece that substantially covers the rear wall 79 of the housing 11.

In installing the liner for the housing 11, the rear wall liner 74 and fron wall liner 76 will first be installed using screws such as the screws 75. After these liners are in place, the side wall liners 80 and 81 will be put into place. As is shown in FIG. 9, the liners 80 and 81 extend completely along the side walls 82 and 84 of the housing 11, and bend to extend somewhat along the upper edge of the front and rear wall liners 74 and 76.

Figure 10:
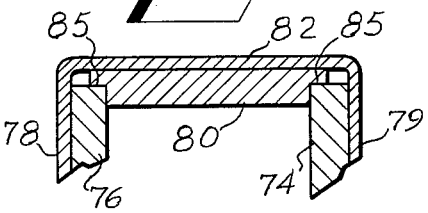
FIG. 10 is an enlarged cross-sectional view taken substantially along the line 10—10 in FIG. 9; and, FIG. 11 is an exploded perspective view showing the interconnection of the end and top linings.

FIG. 10 of the drawings shows that the liner 80 includes grooves 85 to receive the edges of the liners 74 and 76. This arrangement provides tight joints to prevent excessive destruction of the liners by the operation of the shot blasting apparatus. While only the liner 80 is shown, it will be understood that the liner 81 is constructed in the same manner.

Once the liners 80 and 81 are in place, set screws 86 and 88 can be tightened to urge the liners 80 and 81 more firmly against the liners 74 and 76.

Figure 11:
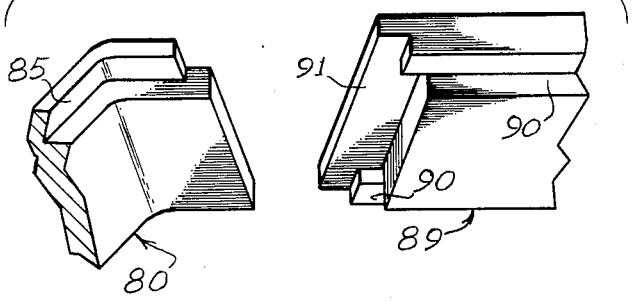

Finally, the upper liner 89 will be put into place. In a further effort to prevent cracks that are the source of excessive destruction of the liner by shot, the arrangement illustrated in FIG. 11 is utilized. It will be seen that the top liner 89 includes a groove 90 similar to the groove 85 in the side liner 80. The edge of this groove 90 is off set so the liner 80 somewhat telescopes with respect to the liner 89. Then, there is a plate 91 that is integrally formed with the top liner 89 and extends over the liners 80 and 81.

When the liners in the housing 11 are to be changed, it will be understood that the cover 18 can be opened, and the top liner 89 can be lifted out. After the set screws 86 and 88 are loosened, the side liners 80 and 81 can be slid upwardly and removed. Thus, one person can rather easily replace the side and top liners as needed without the necessity for removing the wheel 41. When the front and rear liners 76 and 74 must be changed, the wheel 41 must be removed; then, removing screws 75 allows the front and rear liners to be changed.

It will therefore be seen that the present invention provides an improved shot blasting apparatus that is timed to prevent wasted motion and to provide great efficiency in receiving shot, accelerating the shot to a high velocity and discharging the shot in a predictable pattern. The apparatus is designed for minimum destructiveness of the apparatus itself by the shot, and great ease in servicing. The device is also designed to provide for large quantity throughput of shot. It will be realized that the internal efficiency of the wheel of the present invention allows a greater quantity of shot per unit time, but the wheel must also have sufficient open space to allow the shot to pass. Thus, the large diameter of the impeller and the control cage is important. It should be obvious from the foregoing that a greater total area of impeller openings will facilitate greater shot flow, and the area of impeller openings can increase as the diameter increases. Further, since the discharge opening in the control cage varies with the impeller openings, the entire internal flow path is increased by the increase in diameter.

It will of course be understood by those skilled in the art that the particular embodiment of the invention here presented is by way of illustration only, and is meant to be in no way restrictive; therefore, numerous changes may be made, and the full use of equivalents resorted to without departing from the spirit or the scope of the invention as outlined in the appended claims.

I claim:

1. In shot blasting apparatus comprising a blast wheel, a drive shaft for rotating said blast wheel, said blast wheel including a rear wheel plate and a front wheel plate, a hub fixed to said drive shaft for rotation therewith and fixedly receiving said rear wheel plate thereon, a plurality of vanes extending radially of said blast wheel between said front wheel plate and said rear wheel plate, said vanes being equally spaced around said blast wheel, an impeller mounted centrally of said blast wheel, said impeller including a base plate carried by said hub for rotation therewith, a housing for said blast wheel, said housing including a rear wall and a front wall, said front wall defining an opening therein concentric with said impeller, a control cage mounted in said opening in said front wall and selectively fixed with respect to said housing, said control cage including a side wall disposed between said impeller and said vanes of said wheel, a connector between said hub and said impeller for determining the rotational relationship between said hub and said impeller, said hub including a plurality of projections extending therefrom, said projections being equally spaced around said hub and adapted for drivingly engaging said connector, the improvement wherein said plurality of projections from said hub comprises three projections, said connector defines three notches in one side thereof, said three notches being located to receive said projections from said hub in all rotational positions of said connector, said connector includes three pins extending from the opposite side thereof, said pins being equally spaced around said connector, each pin of said three pins being located between two notches of said three notches on one side of said connector, said impeller defines three notches on said base plate, said three notches on said impeller are equally spaced from one another and are adapted to receive said three pins on said opposite side of said connector in all rotational positions of said impeller, said impeller includes nine impeller blades equally spaced therearound parallel to the axis of rotation of said hub, each notch of said three notches on said impeller being radially aligned with one impeller blade of said nine impeller blades, the arrangement being such that all rotational positions of said connector with respect to said hub are mechanically the same, and all rotational positions of said impeller with respect to said connector are mechanically the same, said wheel plates include means for locating said vanes so that said impeller blades are aligned with said vanes in all rotational positions of said impeller, said control cage defines an opening in said side wall, said opening being selectively located between two vanes of said nine vanes for allowing shot to flow from within said control cage to said vanes.

2. In shot blasting apparatus as claimed in claim 1, said discharge opening having an axial dimension equal to the axial dimension of the impeller blades.

3. In shot blasting apparatus as claimed in claim 2, the further improvement wherein said housing includes end walls connecting said front wall and said rear wall, and a cover selectively engageable with all said walls, a liner for said housing, said liner comprising a front liner substantially covering said front wall of said housing and defining an opening therein coinciding with said opening in said front wall of said housing, a rear liner substantially covering said rear wall of said housing and defining an opening therein for receiving said hub, a pair of end liners, each end liner of said pair of end liners including a first part substantially covering an end wall and a second part adjacent to said cover, said end liners being slideably insertable from the top of said housing, said liner further including a top liner extending between said second parts of said end liners and resting thereon.

4. In shot blasting apparatus as claimed in claim 1, the further improvement including a plurality of spacers extending between said front wheel plate and said rear wheel plate for mounting said front wheel plate to said rear wheel plate, each spacer of said plurality of spacers being located between two vanes of said plurality of vanes and bisecting the angle between said two vanes. equally spaced from one another and are adapted to receive said three pins on said opposite side of said connector in all rotational positions of said impeller, said impeller includes nine impeller blades equally spaced therearound parallel to the axis of rotation of said hub, each notch of said three notches on said impeller being radially aligned with one impeller blade of said nine impeller blades, the arrangement being such that all rotational positions of said connector with respect to said hub are mechanically the same, and all rotational positions of said impeller with respect to said connector are mechanically the same, said wheel plates include means for locating said vanes so that said impeller blades are aligned with said vanes in all rotational positions of said impeller, said control cage defines an opening in said side wall, said opening being selectively located between two vanes of said nine vanes for allowing shot to flow from within said control cage to said vanes.

5. In shot blasting apparatus comprising a blast wheel, a drive shaft for rotating said blast wheel, said blast wheel including a rear wheel plate and a front wheel plate, a hub fixed to said drive shaft for rotation therewith and fixedly receiving said rear wheel plate thereon, a plurality of vanes extending radially of said blast wheel between said front wheel plate and said rear wheel plate, said vanes being equally spaced around said blast wheel, an impeller mounted centrally of said blast wheel, said impeller including a base plate carried by said hub for rotation therewith, a housing for said blast wheel, said housing including a rear wall and a front wall, said front wall defining an opening therein concentric with said impeller, a control cage mounted in said opening in said front wall and selectively fixed with respect to said housing and a connector between said hub and said impeller for determining the rotational relationship between said hub and said impeller, the improvement wherein said front wheel plate and said rear wheel plate define central openings therein, and a plurality of pairs of grooves therein extending radially thereof from said central openings to the periphery of said wheel plates, said plurality of pairs of grooves being equally spaced around said wheel plates and equal in number to said plurality of vanes, each pair of grooves of said plurality of pairs of grooves including a rear groove in said rear wheel plate and a front groove in said front wheel plate, each front groove and each rear groove further including a first portion and a second portion, said first portion extending from said center opening in said wheel plate and extending out to a given radius, said first portion having a first depth, said second portion extending from said given radius to the perimeter of said wheel plate, said second portion having a depth less than said first portion so that a transition is provided at said given radius, each vane of said plurality of vanes including a pair of parallel rails spaced apart to be received within said second portion of said pair of grooves, said vane including a pair of stops extending from each of said rails, each stop of said pair of stops being placed on said rail so that the distance from one end of said rail to said stop is equal to the distance from said center opening in said wheel plate to said given radius, said stops being thus placed so that said vane is symmetric and either end of said vane is receivable within said second portion of said groove, said vane being further symmetric so that either rail can be selectively received within said front groove and said rear groove, and each vane further includes a web of uniform cross-section disposed between said rails throughout the length of said vane, said vane being selectively mountable in said blast wheel with either end of said vane outwardly so that said vane can be reversed for providing two wear surfaces, said vane being further selectively mountable with either rail in the front and rear wheel plates so that said vane can be reversed for providing an additional two wear surfaces.

6. In shot blasting apparatus as claimed in claim 5, said vanes having a length such that each of said vanes is receivable through said central opening in said front wheel plate for installation in said pair of grooves.

* * * * *